United States Patent [19]

van Hekken et al.

[11] Patent Number: 5,011,227

[45] Date of Patent: Apr. 30, 1991

[54] ADJUSTABLE FOOTREST FOR A CHAIR

[75] Inventors: Hendrik R. van Hekken, Allentown; Thomas L. Latone, Quakertown, both of Pa.

[73] Assignee: Knoll International, Inc., New York City, N.Y.

[21] Appl. No.: 465,341

[22] Filed: Jan. 16, 1990

[51] Int. Cl.[5] ..... A47C 7/50

[52] U.S. Cl. ..... 297/434; 297/436

[58] Field of Search ..... 297/423, 429, 433, 434, 297/436

[56] References Cited

U.S. PATENT DOCUMENTS

| | | | |
|---|---|---|---|
| Re. 8,380 | 1878 | White et al. . | |
| 341,748 | 5/1886 | Haynes . | |
| 659,933 | 10/1900 | Marks . | |
| 1,590,240 | 6/1926 | Gorton . | |
| 1,723,363 | 8/1929 | McArdle . | |
| 2,308,358 | 1/1943 | Cramer . | |
| 4,148,524 | 4/1979 | Guyton | 297/433 |
| 4,408,801 | 10/1983 | Edel et al. . | |
| 4,509,795 | 4/1985 | Brennan et al. | 297/434 |
| 4,753,407 | 6/1988 | Brock . | |
| 4,819,987 | 4/1989 | Stringer | 297/434 |

*Primary Examiner*—Peter R. Brown

*Attorney, Agent, or Firm*—Mason, Fenwick & Lawrence

[57] ABSTRACT

An adjustable footrest for use on a chair to comfortably accommodate the feet of a user. Defined on the underside of the mounting plate is an elongated hollow housing which receives the essential moving elements of the footrest mechanism. Positioned within the hollow housing is a gas cylinder that contains an actuator pin located on a piston at the upper end of the cylinder. Located near the bottom of the hollow housing is a pair of outwardly projecting legs to which is pivotally mounted an elongated leg. A portion of the leg is positioned within the housing and is pivotally mounted to the connection end of the gas cylinder. The other end of the leg extends away from the hollow housing and terminates in a tranversely positioned footrest. Pulling the handle in an upward direction presses the actuator pin within the gas cylinder, thus releasing the piston. While the user maintains the handle in its top position, the user may then exert a downward force on the footrest. Which causes the bottom leg to pivot and, thus, urge the piston into the cylinder. When the footrest is in a desired position, the handle is released. The footrest maintains a rigid position throughout its range of movement by having the gas cylinder filled with oil on the compression stroke.

22 Claims, 3 Drawing Sheets

ADJUSTABLE FOOTREST FOR A CHAIR

BACKGROUND OF THE INVENTION

1. Field Of Use

The present invention relates to an adjustable footrest for use in a chair where the footrest may assume different positions to comfortably accommodate the feet of a user.

2. Brief Description Of The Prior Art

The present invention finds particular use in chairs where the seat is located a distance away from the ground that is so great that a person sitting in the seat is not able to place their feet on the ground. In such a chair, people may have to allow their feet to dangle over the side of the seat. Under other circumstances, the chair may be provided with a cross-piece disposed between or supported on legs of the chair to provide a convenient place for a person to rest his/her feet. In this situation, the cross-piece is fixed relative to the legs of the chair.

There is thus a need for a footrest that is adjustable at varying heights for use in a chair where the seat is a great distance from the floor with the footrest including a mechanism that is of simple and reliable construction. The present invention is directed toward filling that need.

SUMMARY OF THE PRESENT INVENTION

A chair incorporating the invention generally comprises a conventional five-star pedestal base where each of the legs of the base is supported by a caster to facilitate movement of the chair along a surface. Mounted on the base is a conventional pneumatic height adjustment mechanism. Secured to the height adjustment mechanism is a chair tilting mechanism which in turn supports a chair body that includes a seat and a back.

Fixed to the underside of the tilting mechanism is a footrest adjustment mechanism that includes a mounting plate for securing the mechanism to the underside of the tilt mechanism. Defined on the underside of the mounting plate is an elongated hollow housing which receives the essential moving elements of the footrest mechanism.

Positioned within the hollow housing is a gas cylinder that contains an actuator pin located at the upper end of the cylinder. The lower end of the cylinder contains a moving piston that terminates in a connection end.

Located near the bottom of the hollow housing is a pair of outwardly projecting legs that have holes for receiving a pivot pin. The pin passes through and pivotally mounts an elongated leg to and within the hollow housing. The portion of the leg positioned within the housing is pivotally mounted to the piston of the gas cylinder. The other end of the leg extends away from the hollow housing and terminates in a transversely positioned footrest.

A generally ring-shaped handle terminates at one end in an actuator portion that fits within the hollow housing so that it can act on the head of the actuator pin. The remainder of the handle sits below the chair seat within easy reach of a user or sitter.

Grasping the exposed handle and pulling it in an upward direction presses the actuator pin within the gas cylinder, thus releasing the piston. The piston will move out of the cylinder to a final position where the footrest will be in what is referred to as its "top" position.

While the user maintains the handle in its top position, the user may then exert a downward force on the footrest. Exerting this force on the footrest causes the bottom leg to pivot and, thus, urge the piston into the cylinder. When the footrest is in a desired position, the handle is released. The footrest maintains a rigid position throughout its range of movement by having the gas cylinder filled with oil on the compression stroke.

It is thus a primary object of the present invention to provide an adjustable footrest for use in a chair where the footrest may assume different positions to comfortably accommodate the feet of a user.

It is another object of the present invention to provide a mechanically uncomplicated height adjustment mechanism for a footrest in a chair.

These and other objects will become apparent when reference is made to the following detailed description.

DETAILED DESCRIPTION OF THE PREFERRED EMBODIMENTS

Figure 1:
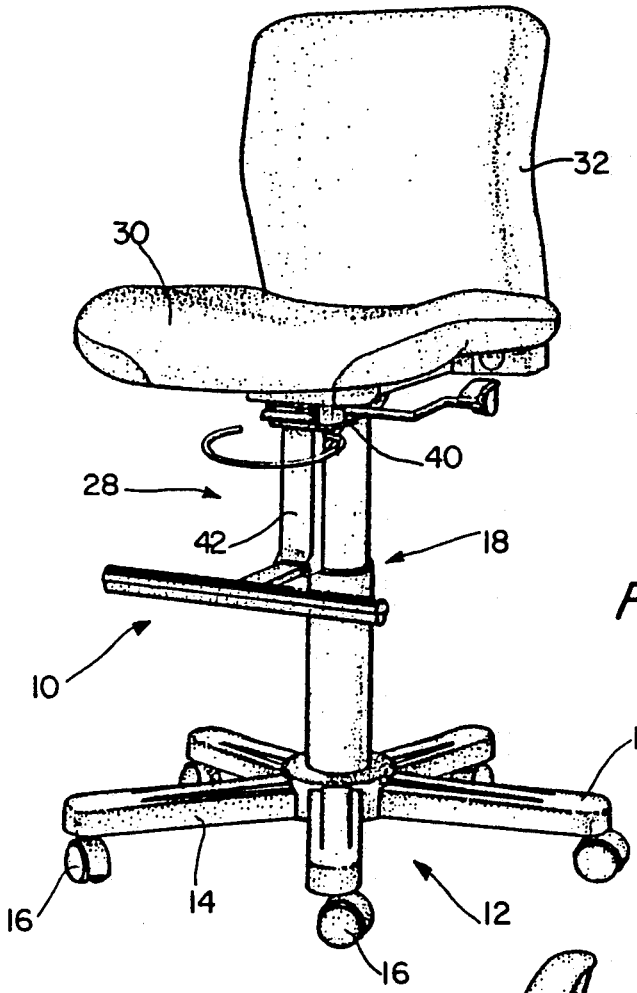
FIG. 1 is a perspective view of a chair incorporating a footrest embodying the teachings of the present invention.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
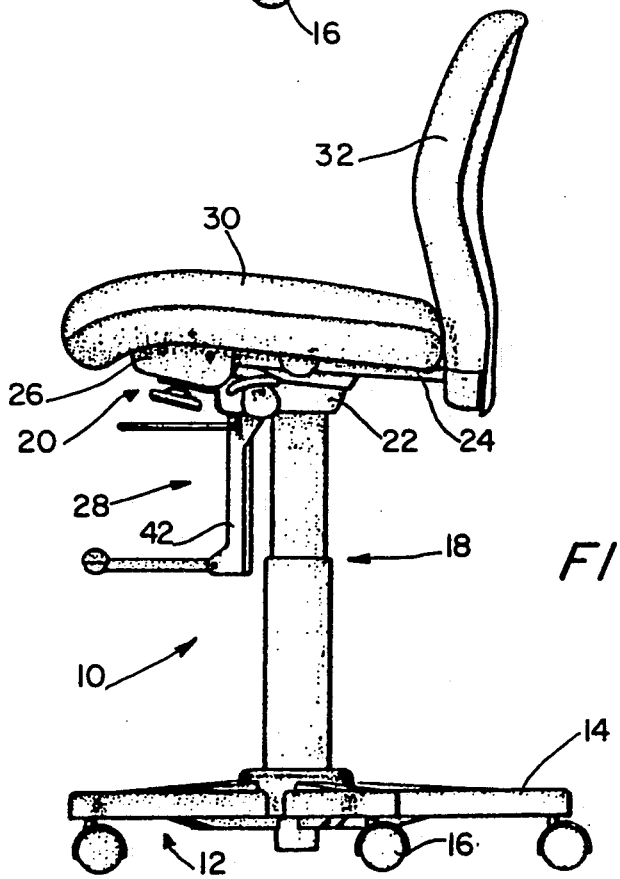
FIG. 2 is a side view of the chair of FIG. 1.
Figure 3:
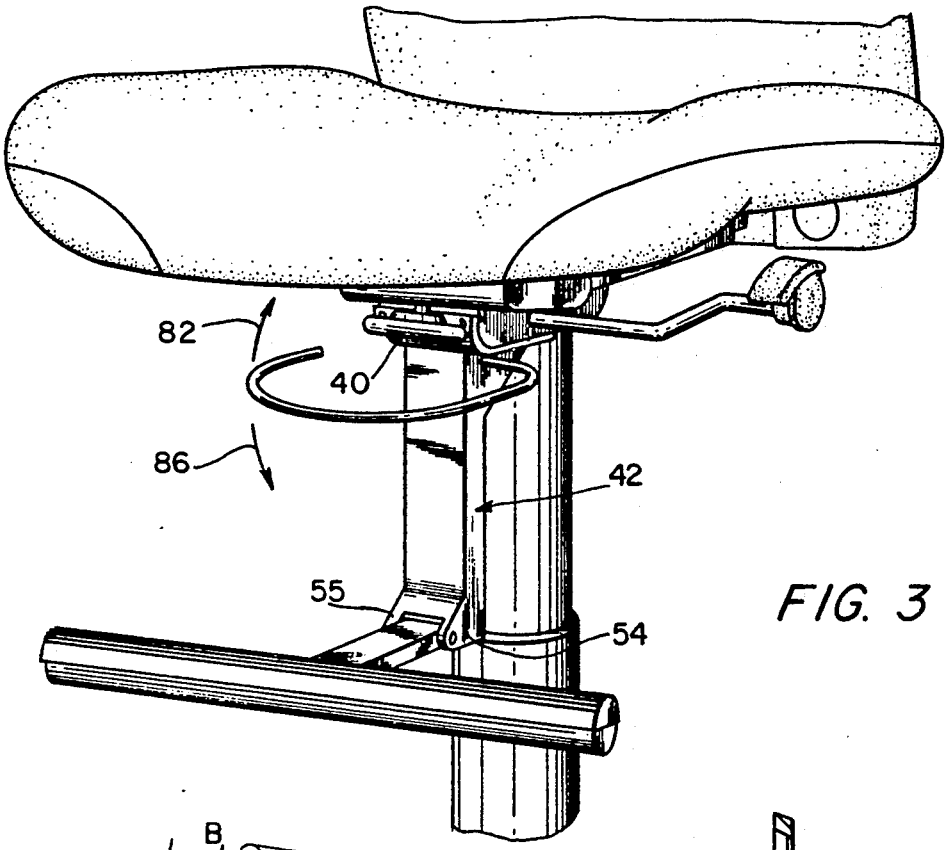
FIG. 3 is a close-up perspective view of the adjustable footrest.

FIGS. 1 through 3 shows a chair 10 incorporating the teachings of the present invention. The chair generally comprises a conventional five-star pedestal base 12 where each of the legs 14 of the base is supported by a caster 16 to facilitate movement of the chair along a surface. Mounted on the base is a conventional pneumatic height adjustment mechanism 18. Secured to the height adjustment mechanism is a chair tilting mechanism 20. In a preferred embodiment, the chair tilting mechanism 20 is of the type discussed co-pending U.S. patent application Ser. No. 465,342 entitled CHAIR TILT AND CHAIR HEIGHT CONTROL APPARATUS, filed on even date herewith, assigned to Knoll International, Inc., the same company as the present application, and incorporated by reference herein. As it relates to the present invention, the tilt mechanism essentially comprises three parts. A housing 22 is mounted atop the height adjustment mechanism 18. A chair back support link 24 is pivotally mounted to the housing. A seat support mounting plate 26 is pivotally mounted to the housing and has secured to it a chair seat structure 30. The chair back support link 24 supports a chair back 32. The structure associated with mounting the chair back 32 to the link 24 includes means by which the height and positioning of the chair back 32 relative to the seat 30 may be adjusted In a preferred embodiment, the height adjusting structure is of the type discussed in co-pending U.S. patent application Ser. No. 465,340 entitled HEIGHT ADJUSTMENT MECHANISM FOR CHAIR BACK, filed on even date herewith, assigned to Knoll International, Inc., the same company as the present application, and incorporated by reference herein.

Fixed to the underside of the housing 22 is a footrest adjustment mechanism 28. In a preferred embodiment, the parts constituting the mechanism are made of steel unless specified otherwise. The adjustment mechanism 28 basically comprises a mounting plate 40 for securing the mechanism to the underside of the housing 22. The plate contains numerous mounting holes 91 that mate with complementary holes defined in the housing 22 in order to receive suitable fasteners, such as screws (not shown). Defined on the underside of the mounting plate is a hollow housing 42 which receives the essential moving elements of the footrest mechanism. The housing is made up of two components. The first component is a steel shell 101 that defines the major housing structure. The second component is a back cover 103 made of injection molded plastic. The back cover 103 is secured to the shell 101 by suitable fasteners, such as screws 105, to complete the housing structure 42.

Figure 4:
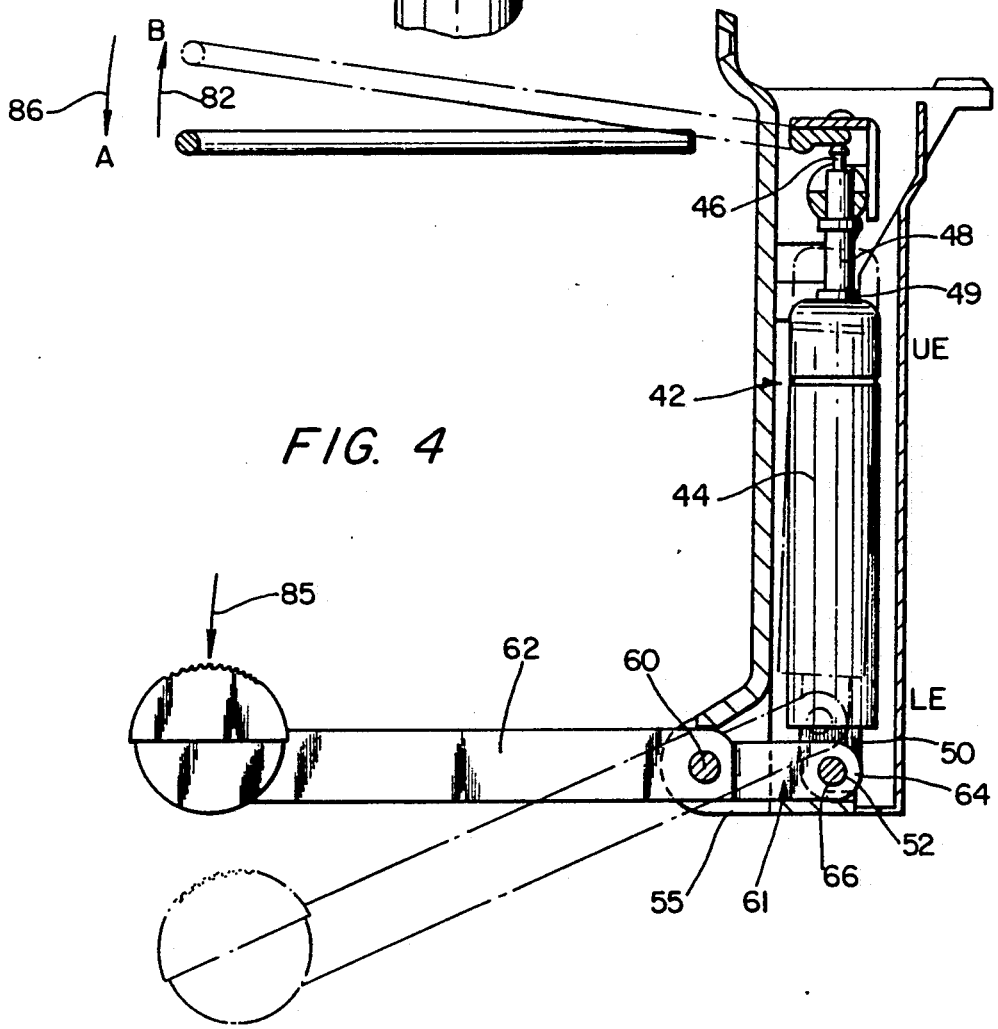
FIG. 4 is side view partly in cross-section of the footrest mechanism of FIG. 3.
Figure 5:
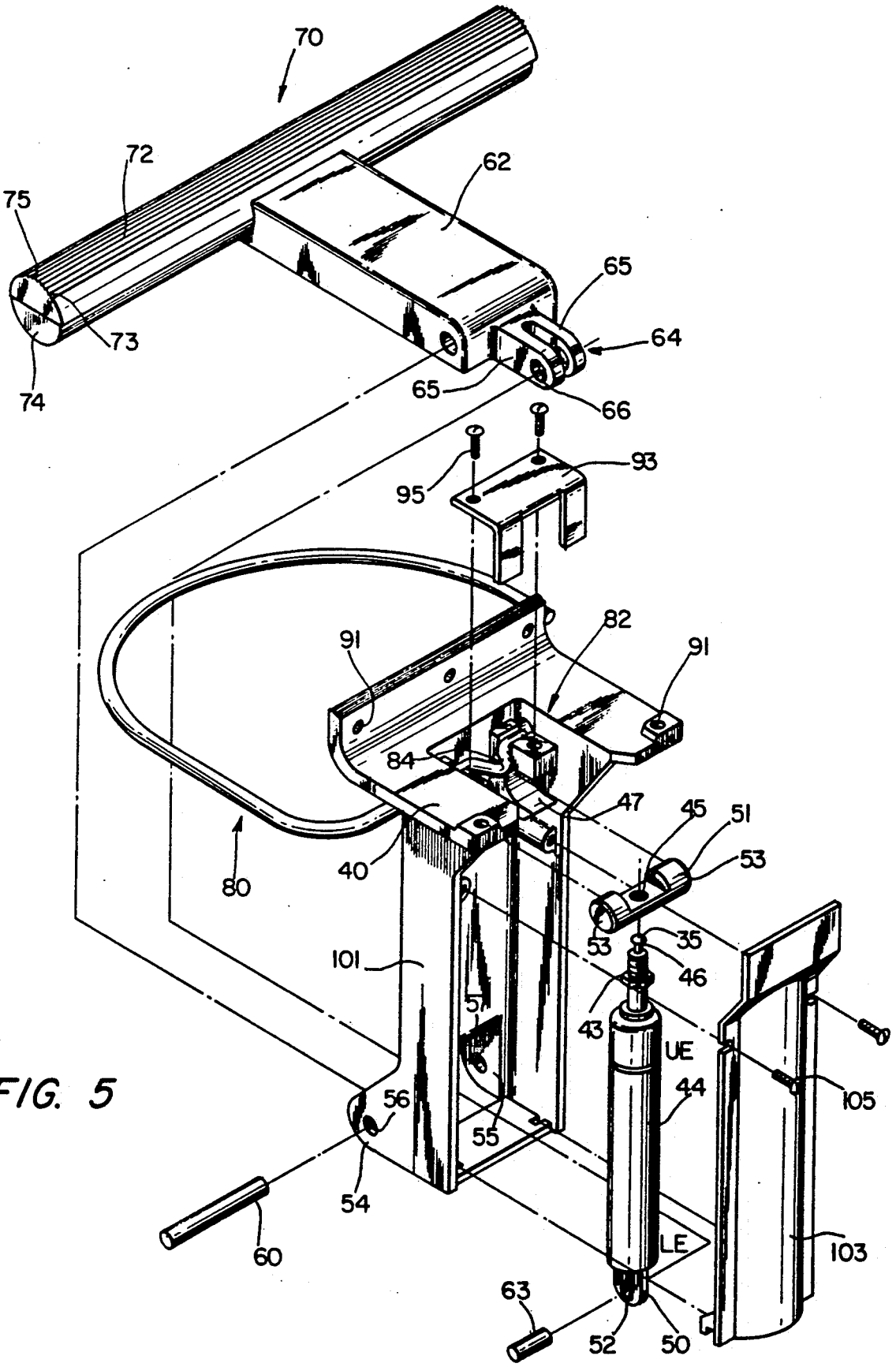
FIG. 5 is an exploded view of the footrest mechanism of FIG. 3.

With reference to FIGS. 4 and 5, positioned within the elongated housing is a gas cylinder 44. The gas cylinder is of the full locking type in that the piston 48 moves within the cylinder without bounce. This is due to the use of an oil charge inside the cylinder. A suitable cylinder is made by Stabilus and is known as a Blok-O-Lift.

As oriented in FIG. 4, the gas cylinder contains an actuator pin 46 located at the upper end UE of the cylinder. The lower end LE of the cylinder terminates in a connection end 50 that contains a through bore 52. Movably mounted within the upper end of the cylinder is a piston 48 that slides within cylinder 44. The piston 48 contains a longitudinal bore within which is movably mounted the actuator pin 46. A trunion or cylindrical cross-piece 51 has a threaded aperture 45 that receives the threaded head end of piston 48. The depth the piston goes through aperture 45 can be adjusted by a nut 43 threadably mounted on the head end of piston 48. The ends 53 of the trunion 51 fit within support channels 47 defined within housing 42. A retainer plate 93 is mounted by fastening screws 95 within the housing 42 to pivotally mount the trunion within the support channels and constrain the handle 80. This arrangement fixes the mounting of the piston while allowing movement of the cylinder 44 within the housing.

Located near the bottom of the housing 42 is a pair of outwardly projecting finger 54 and 55 which contain bores 56 and 57. The bores are aligned with one another and receive a pivot pin 60. The pin passes through and pivotally mounts an elongated leg 62 to and within the housing 42. The portion 61 of the leg positioned within the housing terminates in a yoke-shaped end 64 that includes two parallel fingers, each of which has through bore 66. The through bores 66 are aligned with through bore 52 and receive a pivot pin 63 for pivotally mounting the leg to the end 50 of the gas cylinder. The other end of leg 62 extends away from the housing and terminates in a transversely positioned footrest 70. The footrest is of cylindrical shape and is secured to the leg 62 in a conventional way, such as by welding. The footrest includes an inner tube to which is secured an upper and lower covers 72 and 74 that are preferably made of a thermoplastic elastomer. The upper cover 72 includes a plurality of longitudinal indentations 73 and ribs 75 to provide a surface for receiving the feet of a user.

A generally ring-shaped handle 80 terminates at one end 82 in an actuator portion 84 that fits within the upper portion of the housing 42. The actuator portion 84 is positioned within the housing so that it rest above the head 35 of actuator pin 46. The remainder of the handle 80 is positioned so that it sits below the seat 30 in front of the housing 42 and within easy reach of a user.

With reference to FIG. 4, the normal position for the handle carries the reference numeral A and is such that the exposed portion of the handle is generally horizontal with the actuator portion 84 of the handle sitting atop the knob 35 of the actuator pin. By grasping the exposed handle and pulling it in an upward direction shown by arrow 82 the actuator portion 84 presses the actuator pin 46 within the piston 48, thus releasing the piston 48. The piston will move out of the cylinder 44 to a final position where the footrest will be in what is referred to as its "top" position with the elongated leg 62 being essentially horizontal. As can be seen by the phantom lines in FIG. 4, the cylinder 44 actually moves away from the fixed portion of piston 48 when the piston is released by actuator pin 46.

While the user maintains the handle 80 in its top position B, the user may then exert a downward force on the footrest as generally designated by arrow 85. Exerting this force on the footrest will cause the bottom leg 62 to pivot around pivot pin 60 and, thus, urge the cylinder 44 in the direction of piston 48. When the footrest is in a desired position, the handle 80 is released which will cause the handle to travel in the direction of arrow 86 and, thus, will return to position A. This allows the actuator pin to move out of the cylinder into its normal position and, thus, lock the piston within the cylinder. The footrest maintains a rigid position throughout its range of movement by having the gas cylinder filled with oil on the compression stroke. In this way, the footrest can provide an infinite range of adjustment.

From the above, it is apparent that many modifications and variations of the present invention are possible in light of the above teachings. It is therefore to be understood that, within the scope of the appended claims, the invention may be practiced otherwise than as specifically described.

What is claimed is:

1. An adjustable footrest mechanism for a chair having a base and a seat supported thereon, said footrest mechanism comprising:

an elongated housing;

means for securing said housing to the underside of said seat;

an elongated hydraulic gas cylinder having first and second ends, said cylinder being positioned within said housing;

a movable piston slidably mounted within said cylinder and emerging from said first end, said piston being mounted to said housing;

an elongated leg terminating at one end in a footrest and at the other end in a connection point;

means for pivotally mounting said elongated leg to said housing with said other end being positioned within said housing;

means for pivotally mounting said connection point to the second end of said cylinder; and actuator means for operating said gas cylinder to permit movement of said cylinder relative to said piston thus altering the position of said footrest.

2. The footrest mechanism of claim 1, wherein said actuator is mounted within said housing, and said footrest mechanism further comprises handle means movably mounted to said housing for activating said actuator means.

3. The footrest mechanism of claim 2, wherein said actuator means is secured to said piston.

4. The footrest mechanism of claim 1, wherein said cylinder is mounted in said housing with said first end nearest said seat.

5. The footrest mechanism of claim 1, wherein the activation of said actuator means causes said piston to emerge from said cylinder to place said footrest in a plane that is essentially parallel to a plane defined by said seat.

6. The footrest mechanism of claim 5, wherein said footrest can be manually relocated so long as said actuator means is activated, the deactivation of said actuator means locking said footrest into a relocated position.

7. The footrest mechanism of claim 1, wherein the mounting of said piston to said housing is pivotal mounting.

8. The footrest mechanism of claim 1, wherein the mounting of said connection end to said second end is pivotal mounting.

9. The footrest mechanism of claim 1, wherein said mounting means comprises a pair of spaced substantially parallel fingers projecting outwardly from the end of said housing farthest from the seat, said fingers including a pair of apertures, and a pivot pin mounted in said apertures for supporting the pivotal movement of said elongated leg.

10. A chair having an adjustable footrest, said chair comprising:

a base;

a seat supported on said base;

an elongated housing;

means for securing said housing to the underside of said seat;

an elongated hydraulic gas cylinder having first and second ends, said cylinder being positioned within said housing;

a movable piston slidably mounted within said cylinder and emerging from said first end, said piston being mounted to said housing;

an elongated leg terminating at one end in a footrest and at the other end in a connection point;

means for pivotally mounting said elongated leg to said housing with said other end being positioned within said housing;

means for pivotally mounting said connection point to the second end of said cylinder; and actuator means for operating said gas cylinder to permit movement of said cylinder relative to said piston thus altering the position of said footrest.

11. The chair of claim 10, wherein said actuator is mounted within said housing, and said footrest mechanism further comprises handle means movably mounted to said housing for activating said actuator means.

12. The chair of claim 11, wherein said actuator means is secured to said piston.

13. The chair of claim 10, wherein said cylinder is mounted in said housing with said first end nearest said seat.

14. The chair of claim 10, wherein the activation of said actuator means causes said piston to emerge from said cylinder to place said footrest in a plane that is essentially parallel to a plane defined by said seat.

15. The chair of claim 14, wherein said footrest can be manually relocated so long as said actuator means is activated, the deactivation of said actuator means locking said footrest into a relocated position.

16. The chair of claim 10, wherein the mounting of said piston to said housing is pivotal mounting.

17. The chair of claim 10, wherein the mounting of said connection end to said second end is pivotal mounting.

18. The chair of claim 10, wherein said mounting means comprises a pair of spaced substantially parallel fingers projecting outwardly from the end of said housing farthest from the seat, said fingers including a pair of apertures, and a pivot pin mounted in said apertures for supporting the pivotal movement of said elongated leg.

19. An adjustable footrest mechanism for a chair having a base and a seat supported thereon, said footrest mechanism comprising:

an elongated housing;

means for securing said housing to the underside of said seat;

an elongated hydraulic gas cylinder and piston being positioned within said housing;

an elongated leg terminating at one end in a footrest and at the other end in a connection point;

means for pivotally mounting said elongated leg to said housing with said other end being positioned within said housing;

means for pivotally mounting said connection point to one of said piston and cylinder; and actuator means for operating said gas cylinder to permit movement of said cylinder relative to said piston thus altering the position of said footrest.

20. The footrest mechanism of claim 19, wherein said actuator is mounted within said housing, and said footrest mechanism further comprises handle means movably mounted to said housing for activating said actuator means.

21. The footrest mechanism of claim 19, wherein the activation of said actuator means causes said piston to emerge from said cylinder to place said footrest in a plane that is essentially parallel to a plane defined by said seat.

22. The footrest mechanism of claim 21, wherein said footrest can be manually relocated so long as said actuator means is activated, the deactivation of said actuator means locking said footrest into a relocated position.

* * * * *